US007804259B2

(12) United States Patent
Ootsuka et al.

(10) Patent No.: US 7,804,259 B2
(45) Date of Patent: Sep. 28, 2010

(54) DISCHARGE LAMP BALLAST APPARATUS

(75) Inventors: Yasunori Ootsuka, Tokyo (JP); Naohito Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 501 days.

(21) Appl. No.: 11/988,510

(22) PCT Filed: Jun. 6, 2006

(86) PCT No.: PCT/JP2006/311326

§ 371 (c)(1),
(2), (4) Date: Jan. 9, 2008

(87) PCT Pub. No.: WO2007/029387

PCT Pub. Date: Mar. 15, 2007

(65) Prior Publication Data

US 2009/0121640 A1 May 14, 2009

(30) Foreign Application Priority Data

Sep. 2, 2005 (JP) ..... 2005-255203

(51) Int. Cl.
*H05B 37/02* (2006.01)

(52) U.S. Cl. ..... 315/307; 315/224; 315/287; 315/360

(58) Field of Classification Search ..... 315/129, 315/209 R, 224–226, 247, 254, 274, 276, 315/287, 291, 297, 307–308, 360
See application file for complete search history.

(56) References Cited

U.S. PATENT DOCUMENTS 6,127,789 A * 10/2000 Ishizuka et al. ..... 315/308
2002/0047641 A1* 4/2002 Ito et al. ..... 315/307
2002/0070687 A1* 6/2002 Urakabe et al. ..... 315/291
2002/0175636 A1* 11/2002 Kawasaka et al. ..... 315/224
2004/0113570 A1* 6/2004 Ribarich et al. ..... 315/307

FOREIGN PATENT DOCUMENTS

JP 7-201471 A 8/1995
JP 8-288077 A 11/1996

(Continued)

*Primary Examiner*—Douglas W Owens
*Assistant Examiner*—Tung X Le
(74) *Attorney, Agent, or Firm*—Birch, Stewart, Kolasch & Birch, LLP

(57) ABSTRACT

A discharge lamp ballast apparatus includes a fault detecting section 9*b* of a discharge lamp 6; a first storing section 10 for storing a fault detected; a lighting delay detecting section 9*c*-3 for detecting lighting delay time from beginning of starting operation to lighting of the discharge lamp; a reigniting voltage measuring section 9*c*-5 for measuring a discharge lamp voltage immediately after switching of polarity applied to the discharge lamp according to AC lighting; a measuring section 9*c*-6 for measuring a period of time during which a current does not flow by detecting a discharge lamp current immediately after switching the polarity applied to the discharge lamp according to the AC lighting; a going out counting section 9*c*-4 for counting a number of times of going out by detecting going out during lighting of the discharge lamp; and a second storing section 9*c* for storing the lighting delay, reigniting voltage, period of time during which the current does not flow, and number of times of going out as operation records.

8 Claims, 9 Drawing Sheets

FOREIGN PATENT DOCUMENTS

| | | | |
|---|---|---|---|
| JP | 11-74091 | A | 3/1999 |
| JP | 2000-82592 | A | 3/2000 |
| JP | 2003-317983 | A | 11/2003 |
| JP | 2004-234924 | A | 8/2004 |
| JP | 2004-234925 | A | 8/2004 |
| JP | 2004-234926 | A | 8/2004 |
| JP | 2005-158365 | A | 6/2005 |
| JP | 2005-353357 | A | 12/2005 |

* cited by examiner

DISCHARGE LAMP BALLAST APPARATUS

TECHNICAL FIELD

The present invention relates to a discharge lamp ballast apparatus, and more particularly to a discharge lamp ballast apparatus suitable for lighting metal halide lamps used as headlights of a vehicle such as an automobile.

BACKGROUND ART

As a conventional discharge lamp ballast apparatus with a fault detecting function, there is one that has a section for detecting a power supply voltage and a section for detecting the voltage and current of a discharge lamp; detects a plurality of types of faults according to the discharge lamp voltage, the discharge lamp current and the power supply voltage; stores the number of occurrences of the faults and inhibits lighting the discharge lamp when the number of occurrences of the faults reaches a certain number of times; and enables a worker to check on a display the number of occurrences of the faults stored, thereby making it possible for the worker to check the presence or absence of the faults and their types easily (see Patent Document 1, for example).

In addition, as a conventional discharge lamp ballast apparatus with a function of detecting the life of a discharge lamp, there is one that has an integrating section for counting the cumulative lighting time of the discharge lamp and the number of times of lighting; and has a function of diagnosing that the life span of the discharge lamp exceeds when the cumulative lighting time goes beyond a prescribed CD value, and a function of reducing the prescribed value of the cumulative lighting time for determining the life span with an increase of the number of times of lighting (see Patent Document 2, for example).

Furthermore, as a conventional discharge lamp ballast apparatus that detects a failure of the discharge lamp, there is one that stores the discharge lamp voltage at fixed time intervals, and detects a failure of the discharge lamp from the variations of the voltage (see Patent Document 3, for example).

Patent Document 1: Japanese Patent Laid-Open No. 2000-82592.

Patent Document 2: Japanese Patent Laid-Open No. 2004-234926.

Patent Document 3: Japanese Patent Laid-Open No. 2004-234924.

However, as for the discharge lamp ballast apparatus described in the Patent Document 1, it stores information only about the types of the faults and the number of occurrences. Accordingly, although it can confirm the fact that the faults occur, it can hardly determine the cause of the fault. In addition, as for the discharge lamp ballast apparatus described in the Patent Document 2, although it can detect the life of the discharge lamp at high accuracy, it can hardly detect a fault due to a cause other than life. Furthermore, as for the discharge lamp ballast apparatus described in the Patent Document 3, although it can detect a malfunction of the discharge lamp, it cannot recognize the process the discharge lamp reaches the malfunction. Therefore the conventional discharge lamp ballast apparatuses have a problem in that it is difficult for them to establish the cause of the fault due to the malfunction of the discharge lamp such as early failures of the discharge lamp and deterioration in lighting characteristics due to change over time.

As typical faults whose causes are hardly determined, there are failures in starting the discharge lamp, and going out and blinking during lighting. These faults can arise because of the life of the discharge lamp, and the malfunction of the discharge lamp (conditions within the discharge lamp alter due to the change over time). As for the former case, it is possible to prevent it before it occurs by estimating the life from the cumulative lighting time or the number of times of lighting as the Patent Document 1. As for the latter case, however, it is difficult to achieve early detection of the malfunction of the discharge lamp. In addition, since the fault can occur in particular conditions, it is difficult to reproduce the fault to examine the phenomenon, and this makes it difficult to identify the cause of the fault. Accordingly, as for the fault due to the malfunction of the discharge lamp, there is a problem of being it necessary to normally store the characteristics at the lighting of the discharge lamp to make a decision as to distinctive characteristics of the discharge lamp.

The present invention is implemented to solve the foregoing problems. Therefore it is an object of the present invention to provide a discharge lamp ballast apparatus capable of facilitating determining the cause of a fault by detecting the distinctive characteristics of the discharge lamp by normally storing information for diagnosing the malfunction of the discharge lamp and by collecting information about the discharge lamp at lighting; capable of recognizing conditions of the discharge lamp at a fault by storing the type of the fault at the fault detection and the contents of operation records at the fault detection as fault information; and capable of checking the conditions of the discharge lamp by referring to the stored contents in a trouble with low reproducibility.

DISCLOSURE OF THE INVENTION

The discharge lamp ballast apparatus in accordance with the present invention includes: a power supply section for supplying AC power to a discharge lamp from a DC power supply; a lighting control section connected to the power supply section for controlling operation of the power supply section; a fault detecting section for detecting a fault of the discharge lamp; a first storing section for storing fault detected by the fault detecting section; a lighting delay detecting section for detecting lighting delay time from beginning of starting operation to lighting of the discharge lamp; a reigniting voltage measuring section for measuring a discharge lamp voltage immediately after switching of polarity applied to the discharge lamp according to AC lighting as a reigniting voltage; a no-current flowing duration measuring section for measuring a period of time during which a current does not flow by detecting a discharge lamp current immediately after switching the polarity applied to the discharge lamp according to the AC lighting; a going out counting section for counting a number of times of going out by detecting going out during lighting of the discharge lamp; and a second storing section for storing into a storage device respective outputs of the lighting delay detecting section, the reigniting voltage measuring section, the no-current flowing duration measuring section and the going out counting section as operation records.

The discharge lamp ballast apparatus in accordance with the present invention includes: a power supply section for supplying AC power to a discharge lamp from a DC power supply; a lighting control section connected to the power supply section for controlling operation of the power supply section; alighting delay detecting section for detecting lighting delay time from beginning of starting operation to lighting of the discharge lamp; a reigniting voltage measuring section for measuring a discharge lamp voltage immediately after switching of polarity applied to the discharge lamp according to AC lighting as a reigniting voltage; a no-current flowing duration measuring section for measuring a period of time during which a current does not flow by detecting a discharge lamp current immediately after switching the polarity applied to the discharge lamp according to the AC lighting; a going out counting section for counting a number of times of going out by detecting going out during lighting of the discharge lamp; a second storing section for storing into a storage device respective outputs of the lighting delay detecting section, the reigniting voltage measuring section, the no-current flowing duration measuring section and the going out counting section as operation records; a fourth storing section for storing a lighting history of the discharge lamp; a decision section for making a decision of a state of the discharge lamp on a basis of information stored in the second storing section and in the fourth storing section; and a warning section for notifying a driver of the state of the discharge lamp on a basis of a decision result of the decision section.

The present invention has an advantage of being able to identify, if a fault occurs, the cause of the fault easily. In addition, the present invention has an advantage of being able to decide the lighting state of the discharge lamp, to estimate the deterioration or malfunction of the discharge lamp before a fault occurs, and to notify, when a fault is anticipated, a driver of that fact.

BEST MODE FOR CARRYING OUT THE INVENTION

The best mode for carrying out the invention will now be described with reference to the accompanying drawings to explain the present invention in more detail.

Embodiment 1

Figure 1:
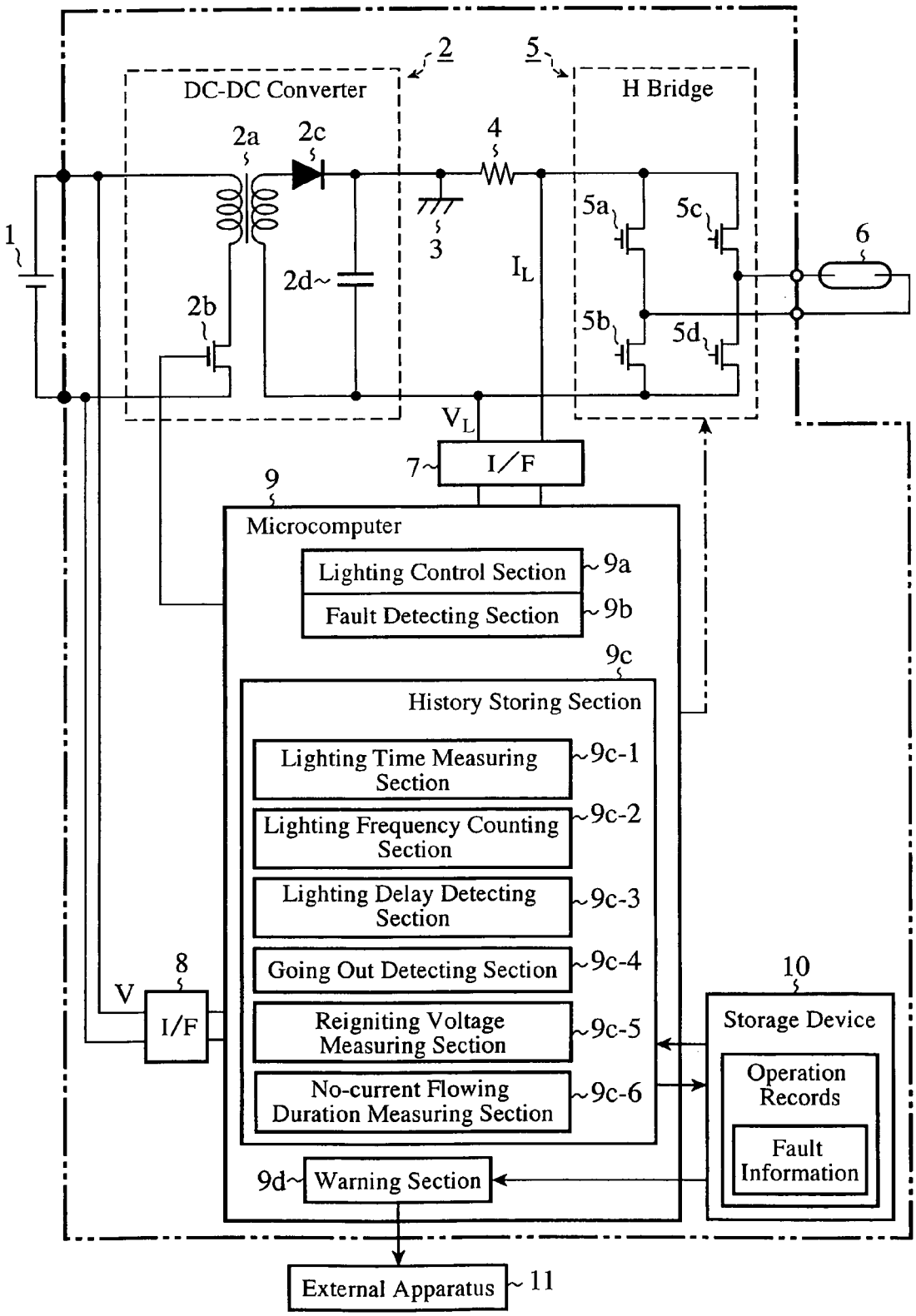
FIG. 1 is a diagram showing a configuration of a discharge lamp ballast apparatus of an embodiment 1 in accordance with the present invention.

FIG. 1 is a diagram showing a configuration of a discharge lamp ballast apparatus of an embodiment 1 in accordance with the present invention.

In FIG. 1, a DC-DC converter (power supply regulating section) 2 is installed for regulating the power fed from a DC power supply 1 such as a battery and for outputting it. The DC-DC converter 2 includes a transformer 2*a* having a primary winding and a secondary winding, a FET 2*b* provided at the primary side of the transformer 2*a*, and a diode 2*c* connected to the secondary side of the transformer 2*a*.

The diode 2*c* has its cathode side connected to a ground 3 and to an H bridge (discharge lamp driving section) 5 via a discharge lamp current detecting shunt resistance 4 for detecting the discharge lamp current $I_L$. The H bridge 5 includes FETs 5*a*-5*d* arranged in an H shape for converting the DC power regulated by the DC-DC converter 2 to AC power, and the AC power passing through the conversion by the H bridge 5 drives a discharge lamp 6 provided at its output side.

The DC-DC converter 2 and the H bridge 5 constitute a power supply section for supplying the AC power to the discharge lamp 6 from the DC power supply 1.

In addition, there are provided a discharge lamp voltage/current input I/F 7 for inputting the discharge lamp voltage $V_L$ from the negative side output of the DC-DC converter 2 and for inputting the discharge lamp current $I_L$ from the H bridge 5 side of the shunt resistance 4; a power supply voltage input I/F 8 for inputting the power supply voltage V of the DC power supply 1; and a microcomputer 9 as a decision section for controlling the FET 2*b* of the DC-DC converter 2 in such a manner that the power supplied to the discharge lamp 6 becomes a prescribed value in response to the discharge lamp voltage $V_L$ and the discharge lamp current $I_L$ which are successively detected via the I/F 7, and for carrying out on/off control of the FETs 5*a*-5*d* of the H bridge 5. The microcomputer 9 has a function of detecting various types of faults in response to the discharge lamp voltage $V_L$ and the discharge lamp current $I_L$ fed from the I/F 7 and to the power supply voltage V fed from the I/F 8.

The microcomputer 9 includes a lighting control section 9*a* for controlling lighting of the discharge lamp 6; a fault detecting section 9*b* for detecting a fault of the discharge lamp 6; a history storing section 9*c* for always detecting operation records of the discharge lamp 6 in response to the discharge lamp voltage $V_L$ and the discharge lamp current $I_L$ fed from the I/F 7 and for storing the operation records in a storage device 10; and a warning section 9*d* for notifying a user of the presence and absence of a fault at the fault detection. The warning section 9*d* increases the level of warning the driver as the malfunction level of the discharge lamp 6 rises. In addition, the history storing section 9*c* includes a lighting time measuring section 9*c*-1 for measuring the lighting time of the discharge lamp 6; a lighting frequency counting section 9*c*-2 for counting the number of times of lighting of the discharge lamp 6; a lighting delay detecting section 9*c*-3 for detecting the lighting delay of the discharge lamp 6; a going out detecting section 9*c*-4 for detecting the going out of the discharge lamp 6; a reigniting voltage measuring section 9*c*-5; and a no-current flowing duration measuring section 9*c*-6. Furthermore, the storage device 10 is provided for exchanging the operation records and the fault information with the history storing section 9*c*. The storage device 10 includes a first storing section for storing the fault detected by the fault detecting section 9*b*.

In addition, the history storing section 9*c* includes a second storing section for storing the respective outputs of the lighting delay detecting section 9*c*-3, going out counting section 9*c*-4, reigniting voltage measuring section 9*c*-5, and no-current flowing duration measuring section 9*c*-6 into the storage device 10 as the operation records; a third storing section for storing the time of occurrence of the fault stored in the first storing section, and the lighting conditions at the time of the fault occurrence (such as the cumulative lighting time, the cumulative number of times of lighting, and power supply voltage); and a fourth storing section for storing the lighting history of the discharge lamp 6. The lighting history stored in the fourth storing section includes the cumulative lighting time, the cumulative number of times of lighting, the number of times of going out, the lighting delay time, the bulb voltage transition due to the change over time, and the number of times of the past starting failures. Here, the third storing section and the fourth storing section can be configured with the same memory. Thus, the operation records and the fault information stored in the storage device 10 can be confirmed by an external apparatus 11 via the warning section 9*d*.

Having the third storing section makes it possible, even if a plurality of types of faults have occurred several times in the past, to identify the cause of the present fault according to the time of occurrence of the fault, the lighting conditions at that time and the respective outputs of the lighting delay detecting section 9*c*-3, reigniting voltage measuring section 9*c*-5, no-current flowing duration measuring section 9*c*-6 and going out counting section 9*c*-4. In addition, although not shown, an output section is provided for outputting the stored contents of the first storing section, second storing section or third storing section. As the output section, an output connector can be used through which various pieces of information can be read for grasping the situation.

Here, the individual operation records and their contents will be described.

Figure 2:
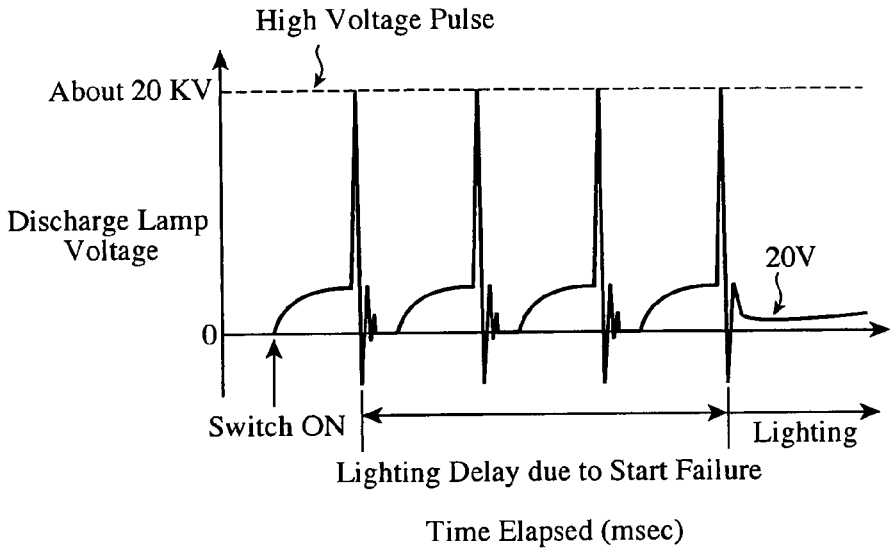
FIG. 2 is a waveform diagram illustrating an example of the voltage/current at polarity switching in the discharge lamp ballast apparatus of the embodiment 1 in accordance with the present invention.

First, the frequency of occurrence of the lighting delay of the discharge lamp 6 will be described. To start the discharge lamp 6, the discharge lamp ballast apparatus applies a high-voltage pulse of 20 kV or more to the discharge lamp 6. If the appliance of the high-voltage pulse cannot start the discharge lamp 6, the high-voltage pulses are successively applied until the discharge lamp 6 starts as shown in FIG. 2. To protect the discharge lamp 6, a maximum period of time of applying the high-voltage pulses is set, and if the discharge lamp 6 does not start during the period of time, the operation is stopped as a starting failure. If the starting characteristics of the discharge lamp 6 deteriorate because of its change over time, the high-voltage pulses must be applied several times until it starts, and this causes the lighting delay. Thus, the deterioration of the starting characteristics of the discharge lamp 6 can be detected early by measuring the lighting delay time and by storing the frequency of occurrence of the lighting delay in the storage device 10 as the operation records. This makes it possible to notify the user of the malfunction of the discharge lamp 6 before it results in a complete failure of starting.

Next, periods during which the reigniting voltage or current of the discharge lamp 6 does not flow.

Figure 3:
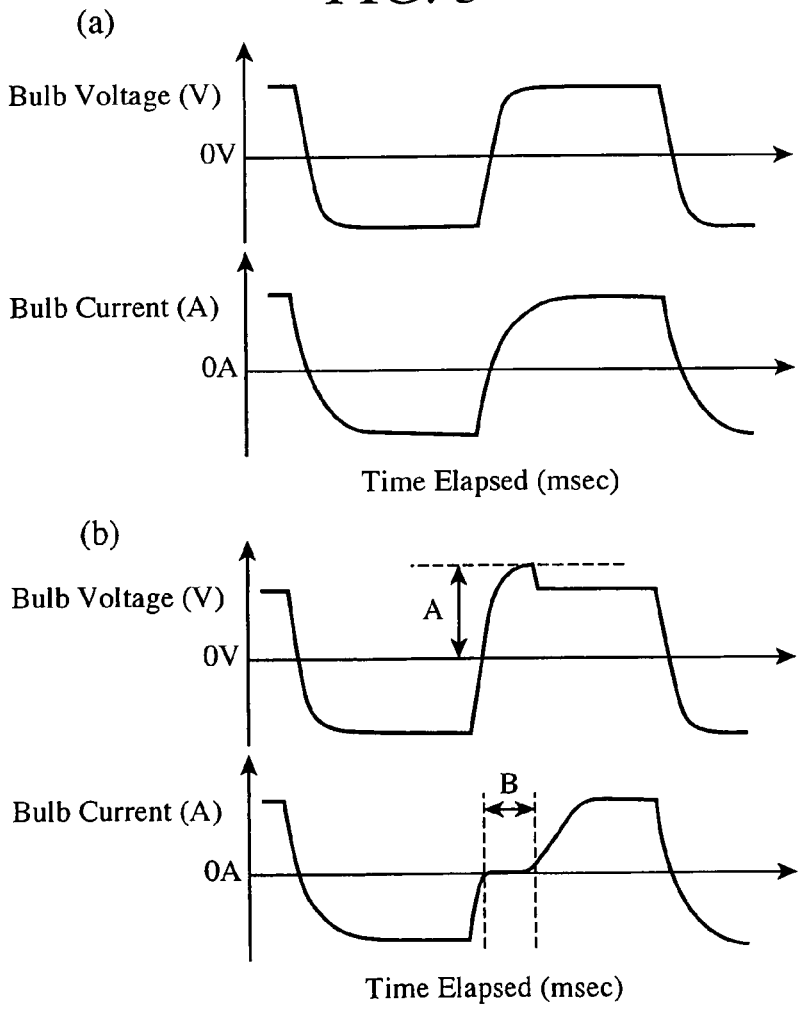
FIG. 3 is a waveform diagram illustrating high-voltage pulses in a starting failure for explaining the operation of the discharge lamp ballast apparatus of the embodiment 1 in accordance with the present invention.

To light the discharge lamp 6 with an AC, the discharge lamp ballast apparatus switches its output polarity at a period of 200 Hz-1 kHz, for example. However, if the lighting characteristics of the discharge lamp 6 deteriorate because of its change over time, the current comes to interrupt easily at the polarity switching, and flicker occurs by going out instantaneously and lighting again. The interruption and relighting within one cycle of the AC, however, cannot be perceived visually. FIG. 3 is a waveform diagram illustrating the voltage/current of the discharge lamp at the polarity switching: FIG. 3(*a*) illustrates waveforms at the normal polarity switching of the discharge lamp; and FIG. 3(*b*) illustrates the waveform at the abnormal polarity switching of the discharge lamp. As illustrated in FIG. 3(*b*), if the current interrupts at the polarity switching, the output voltage of the discharge lamp ballast apparatus increases, and if it reaches a certain voltage (A of FIG. 3(*b*)), the current increases to return to a discharge. The voltage A (reigniting voltage) for the discharge lamp 6 to return to the discharge state increases with the change over time of the discharge lamp 6. The increase in the reigniting voltage makes it difficult to maintain the discharge, and will bring about visually perceivable flicker or going out. In addition, as the interruption period of the current (B of FIG. 3(*b*)) increases, returning to the discharge state will become more difficult.

Thus, the malfunction of the discharge lamp 6 can be detected early before it is perceived visually by measuring the reigniting voltage and the period of time during which the current does not flow during the lighting of the discharge lamp 6 and by storing them as the operation records. This makes it possible to notify the user of the malfunction of the discharge lamp 6 before the going out or flicker of the discharge lamp 6 occurs. In addition, in case of the going out of the discharge lamp 6, it is possible to determine its cause whether it is due to the malfunction of the discharge lamp 6 or not by checking the reigniting voltage and/or the period of time during which the current does not flow according to the operation records.

Next, the number of times of going out of the discharge lamp 6 during lighting will be described.

As described above, by measuring and storing the reigniting voltage and the period of time during which the current does not flow, the malfunction of the discharge lamp 6 can be detected early before it cannot be perceived visually. Furthermore, by storing the number of times of going out occurring during the lighting of the discharge lamp 6 as the operation records, a decision can be made as to whether it is difficult for the discharge lamp 6 to maintain the lighting. This makes it possible to notify the user of the need for replacement of the discharge lamp 6. A worker can decide as to whether a fault due to the malfunction of the discharge lamp 6 has occurred or not by checking the reigniting voltage, the period of time during which the current does not flow and the number of times of going out stored.

Next, the cumulative lighting time and the cumulative number of times of lighting of the discharge lamp 6 will be described.

Generally, according to the cumulative lighting time and the cumulative number of times of lighting of the discharge lamp 6, the life of the discharge lamp 6 can be estimated. In addition, by storing the cumulative lighting time along with the lighting delay time, the reigniting voltage, the period of time during which the current does not flow and the number of times of going out of the discharge lamp 6 as the operation records, the cause of the phenomenon can be guessed whether it comes from the life of the discharge lamp 6 or from the malfunction the discharge lamp 6 has. Furthermore, if the lighting delay or going out of the discharge lamp 6 occurs frequently although its life does not reach its end, a decision can be made that its cause is the malfunction of the discharge lamp 6, thereby being able to notify the user early.

Next, the change over time of the discharge lamp voltage of the discharge lamp 6 will be described.

Figure 4:
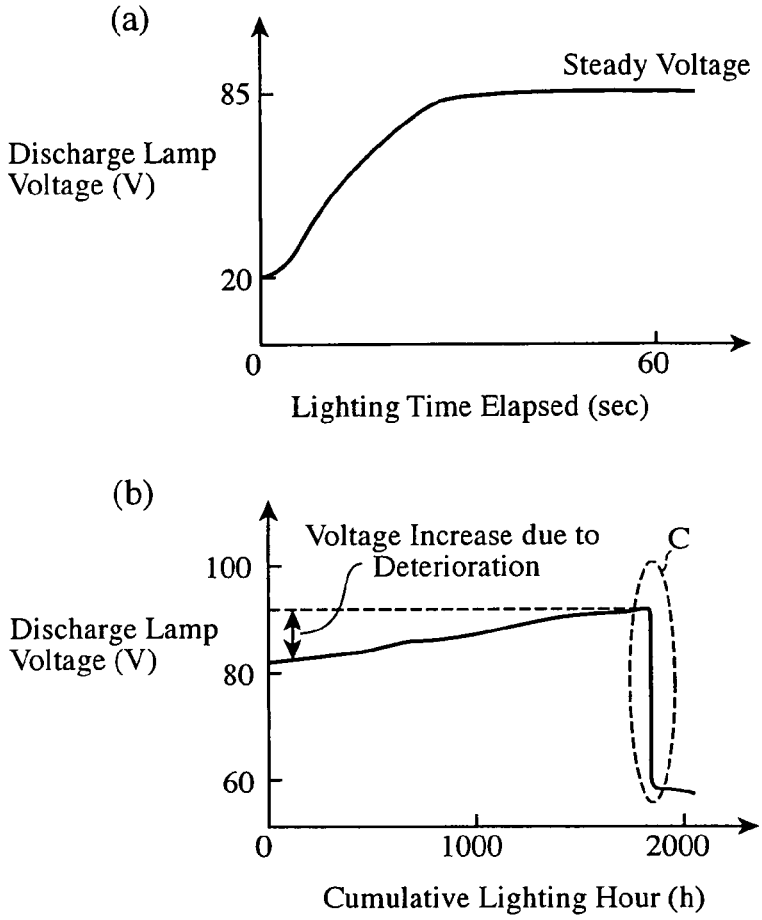
FIG. 4 is a waveform diagram illustrating transition of a voltage variation and steady voltage during lighting of the discharge lamp in the discharge lamp ballast apparatus of the embodiment 1 in accordance with the present invention.

FIG. 4 illustrates waveforms of the transition of the voltage at the lighting of the discharge lamp and of the transition of the steady voltage. Usually, since the steady voltage of the discharge lamp 6 increases with its change over time, the life of the discharge lamp 6 can be estimated to some degree from the steady voltage. However, since the steady voltage varies with each discharge lamp 6 because of the individual difference, it is necessary to check the difference of an increase from the initial steady voltage. Accordingly, using the cumulative lighting time described above, the degree of the progress of the deterioration of the discharge lamp 6 can be estimated as illustrated in FIG. 4(*b*) by storing the relationships between the cumulative lighting time of the discharge lamp 6 and the steady voltage as the change over time of the discharge lamp voltage in the operation records. In addition, since the discharge lamp voltage indicates the operation state of the discharge lamp 6, when a malfunction occurs in the discharge lamp 6, some variations are assumed to appear in the discharge lamp voltage as well. For example, if a crack occurs in the discharge lamp 6, the discharge lamp voltage drops suddenly as indicated by C of FIG. 4(*b*). Accordingly, by storing the change over time of the steady voltage of the discharge lamp 6, the sudden variation in the steady voltage can be recognized. In addition, detection of the sudden variation in the steady voltage of the discharge lamp 6 enables making a decision that the malfunction of the discharge lamp 6 occurs, and enables notifying the user of the necessity of its replacement.

Next, the storage of the fault information about the discharge lamp 6 will be described.

If a lighting fault occurs such as a starting failure or going out of the discharge lamp 6, the cause of the fault can be identified in a short term by detecting the fault and stopping the lighting operation, and by storing the type of the fault detected, the operation records at the occurrence of the fault, the lighting time elapsed, and the discharge lamp voltage as the fault information because it enables recognizing the degree of deterioration and lighting state of the discharge lamp 6 at the occurrence of the fault. In addition, the state of the discharge lamp at the occurrence of the fault and the occurrence conditions (at the start of lighting, at initial lighting, and during steady lighting), which can be recognized from the fault information, are effective for identifying the cause of the fault with low reproducibility, which can occur only in particular conditions.

Next, a detecting method of the operation records of the discharge lamp 6 by the microcomputer 9 will be described.

First, as for the lighting delay time of the discharge lamp 6, the storage of the lighting delay is carried out after the lighting of the discharge lamp 6: the lighting delay detecting section 9*c*-3 measures the time from the generation of a start pulse to the lighting, and writes the time in the storage device 10. As for the reigniting voltage, its detection is carried out during the lighting of the discharge lamp 6: the voltage $V_L$ immediately after the H bridge 5 switches the polarity of the applied voltage is detected and stored in the storage device 10. As for the period of time during which the current of the discharge lamp does not flow immediately after the switching of the polarity applied to the discharge lamp according to the AC lighting, its measurement is carried out during the lighting of the discharge lamp 6: the measurement of the period of time during which the current does not flow is started immediately after the H bridge 5 switches the polarity of the applied voltage, and is continued up to the time when the discharge lamp voltage $V_L$ exceeds a prescribed threshold value. Then, the measured value of the period of time during which the current does not flow is stored in the storage device 10.

As for the going out during the lighting of the discharge lamp 6, the storage of the going out is performed during the lighting of the discharge lamp 6: a decision is made that the going out occurs if the voltage $V_L$ of the discharge lamp continues to be equal to or greater than a prescribed threshold value and if the current $I_L$ of the discharge lamp 6 continues to be equal to or less than a prescribed threshold value for a fixed period, and the number of times of going out is written in the storage device 10. As for the cumulative lighting time discharge lamp 6, its storage is carried out during the lighting of the discharge lamp 6: the preceding cumulative lighting time is read from the storage device 10, the time elapsed from the preceding storage is added, and the new cumulative lighting time is written in the storage device 10. As for the cumulative number of times of lighting of the discharge lamp 6, its storage is carried out after starting the discharge lamp 6: the preceding cumulative number of times of lighting is read from the storage device 10, the cumulative number of times of lighting is counted, and the new cumulative number of times of lighting is written in the storage device 10. As for the change over time of the discharge lamp voltage of the discharge lamp 6, its storage is carried out during the lighting of the discharge lamp 6: the discharge lamp voltage $V_L$ of the discharge lamp 6 at the time when prescribed cumulative lighting time has elapsed is written in the storage device 10.

Next, the operation will be described with reference to flowcharts of FIG. 5-FIG. 12.

Figure 5:
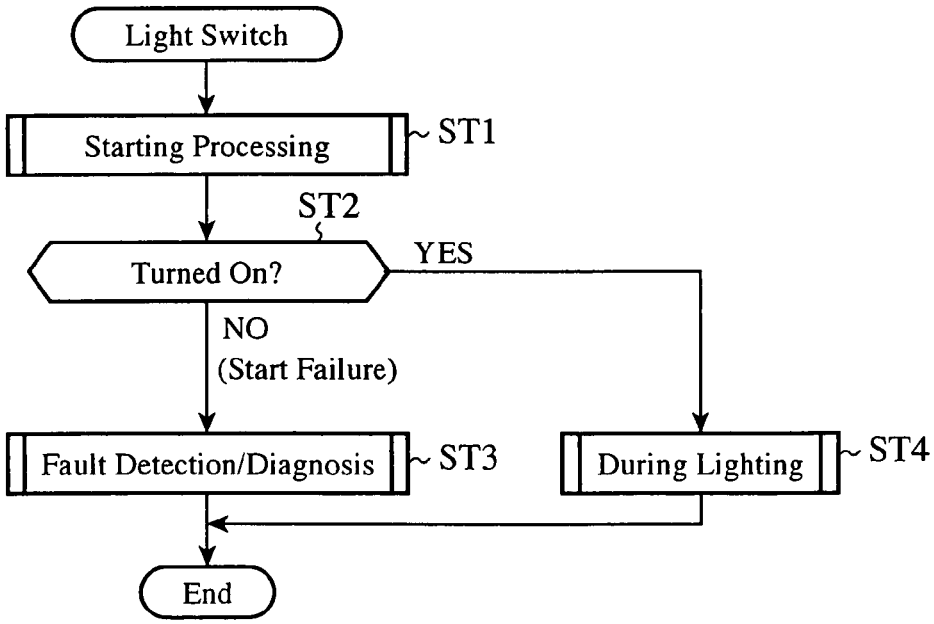
FIG. 5 is a flowchart illustrating starting processing of the discharge lamp in the discharge lamp ballast apparatus of the embodiment 1 in accordance with the present invention.
Figure 6:
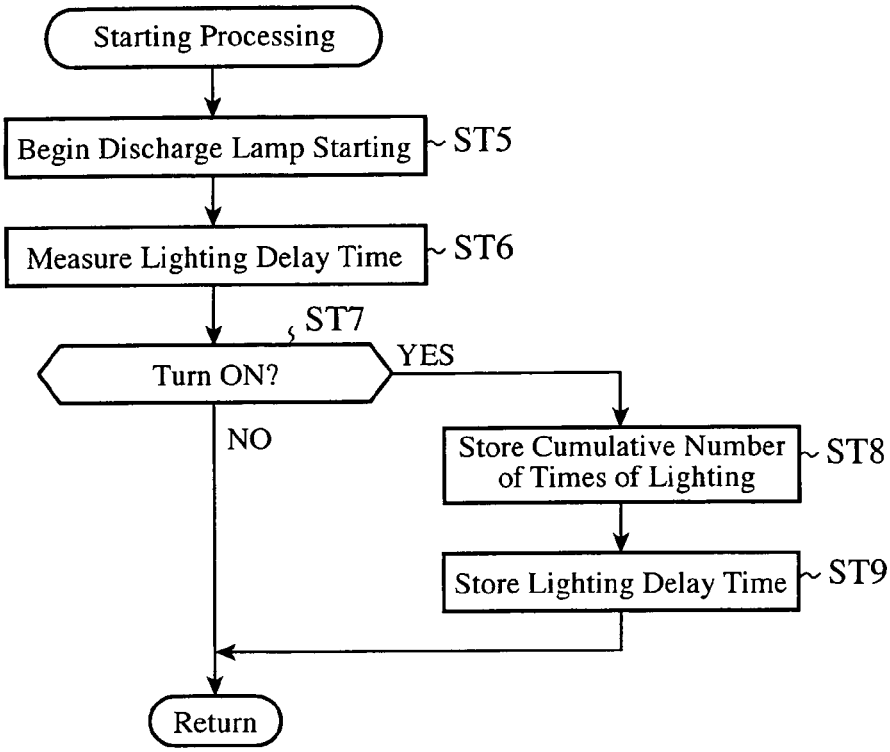
FIG. 6 is a flowchart illustrating operation of the starting processing of the discharge lamp in the discharge lamp ballast apparatus of the embodiment 1 in accordance with the present invention.

FIG. 5 and FIG. 6 are flowcharts illustrating storing processing of the operation records at the starting of the discharge lamp.

In FIG. 5, first, the processing enters the starting processing of a subroutine 2 (FIG. 6) for storing the cumulative number of times of lighting and the lighting delay time of the discharge lamp 6, which will be described later (step ST1). Subsequently, a decision is made as to whether the discharge lamp 6 lights or not from the on state of the DC power supply 1 fed via the I/F 8 (step ST2). If the discharge lamp 6 lights, the processing proceeds to a subroutine 3 (FIG. 7) of "during lighting" which serves to store the lighting time, cumulative lighting time, reigniting voltage, and the time in which the current does not flow, and which will be described later (step ST4). Unless the discharge lamp 6 lights, the processing proceeds to a subroutine 6 (FIG. 10) which carries out the fault detection/diagnosis of the power supply voltage malfunction, of the discharge lamp voltage malfunction, of the starting failure, and of an output short circuit (short circuit/ground fault/supply fault) (step ST3).

In FIG. 6, the processing begins the starting of the discharge lamp 6 (step ST5); measures the delay time up to the lighting of the discharge lamp 6 (step ST6); makes a decision of the lighting of the discharge lamp 6 (step ST7); stores the cumulative number of times of lighting into the storage device 10 when the discharge lamp 6 lights up (step ST8); and stores the lighting delay time into the storage device 10 when the lighting delay occurs at the starting (step ST9). Thus, during startup of the discharge lamp 6, the cumulative number of times of lighting and the lighting delay time are stored, followed by returning to the initial state of the starting processing. In addition, when the discharge lamp 6 does not light at step ST7, the processing returns to the initial state of the starting processing to repeat the same operation as described above.

Figure 7:
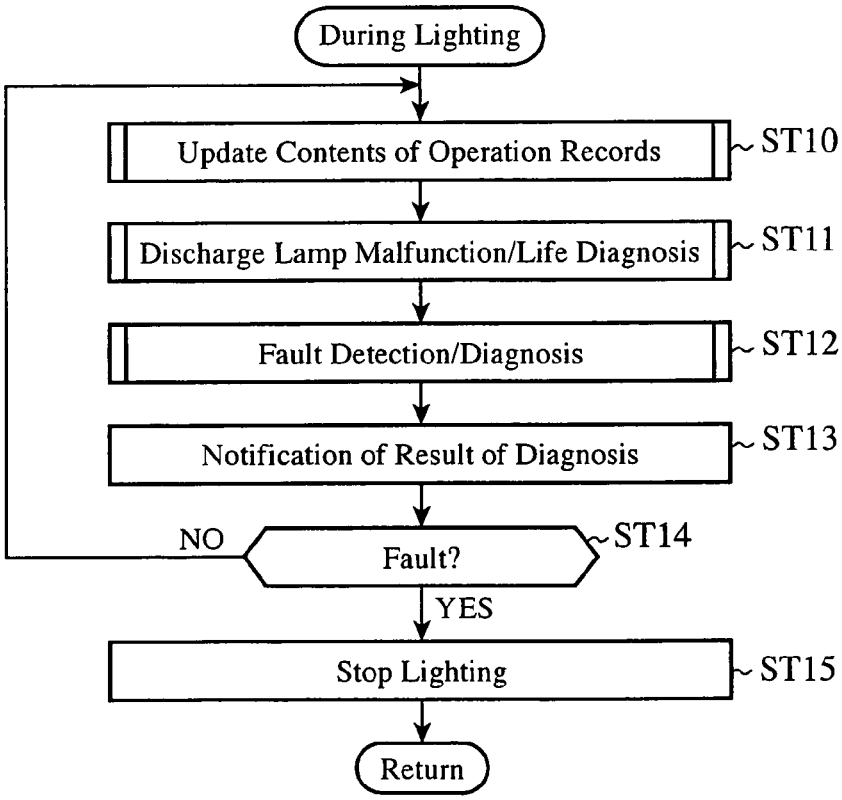
FIG. 7 is a flowchart illustrating operation during lighting of the discharge lamp in the discharge lamp ballast apparatus of the embodiment 1 in accordance with the present invention.

FIG. 7 is a flowchart illustrating storing processing of the operation records during lighting of the discharge lamp, which corresponds to the subroutine 3 at step ST4 of FIG. 5.

In FIG. 7, a subroutine 4 (FIG. 8) is executed first, which updates the contents of the operation records about the lighting time, the cumulative lighting time, the reigniting voltage, and no-current duration of the discharge lamp 6, and which will be described later (step ST10). Subsequently, a subroutine 5 (FIG. 9) is executed which carries out the discharge lamp malfunction/life diagnosis, that is, the diagnosis of the malfunction and life of the discharge lamp 6 according to the operation records, and which will be described later (step ST11). Subsequently, a subroutine 6 (FIG. 10) is executed which carries out the fault detection/diagnosis, that is, the detection of various faults and the diagnosis in case of detecting a fault, and which will be described later (step ST12). Then the processing notifies the user of the diagnostic result (step ST13), and makes a decision as to whether the diagnostic result is a fault or not (step ST14). If it is not a fault, the processing returns to step ST10 to repeat the foregoing operation. In contrast, if it is a fault, the processing halts the lighting of the discharge lamp 6 for the sake of safety (step ST15), and returns to the initial state of lighting to repeat the same operation as described above.

Figure 8:
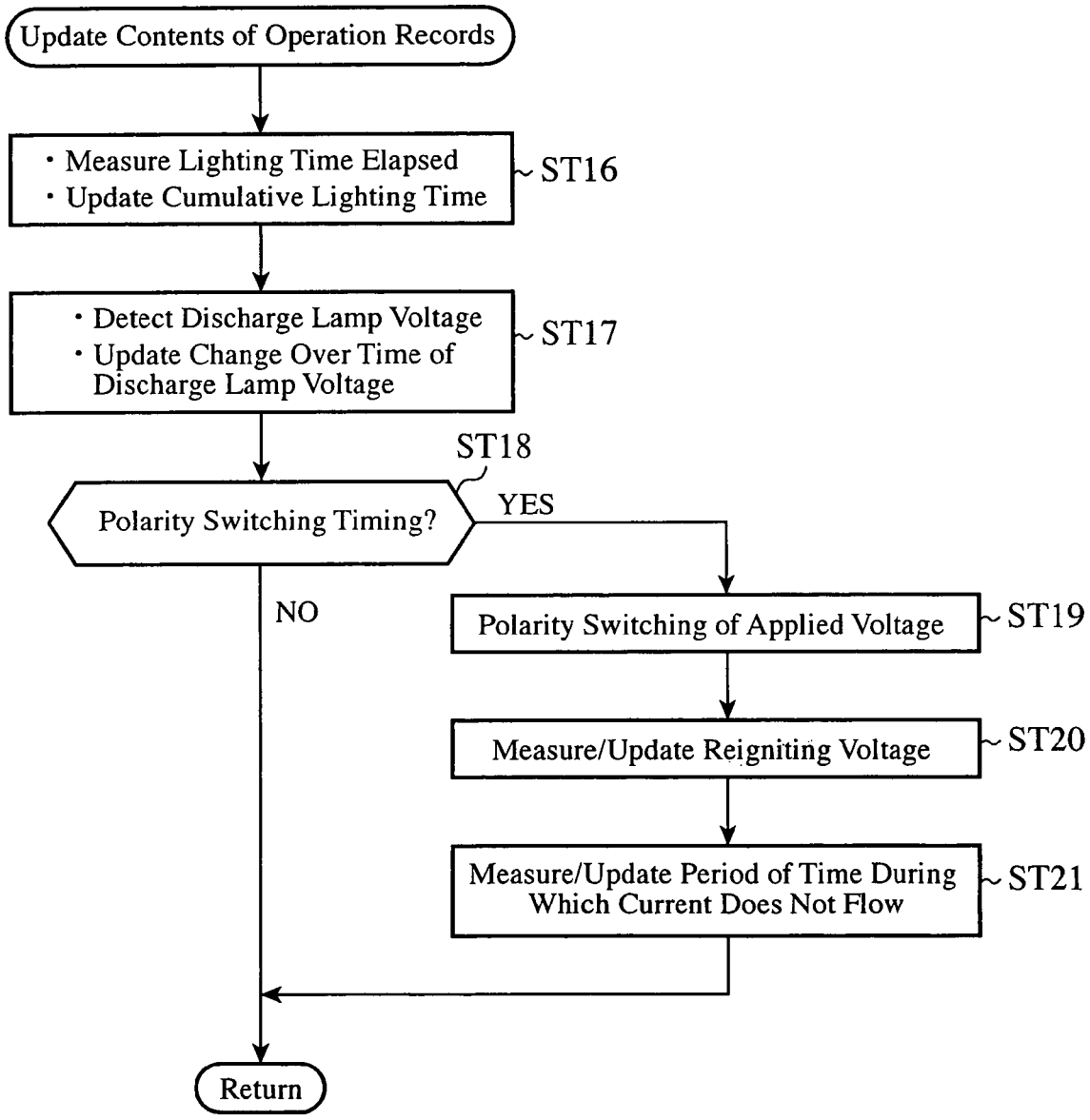
FIG. 8 is a flowchart illustrating update operation of the operation record contents in the discharge lamp ballast apparatus of the embodiment 1 in accordance with the present invention.

FIG. 8 is a flowchart illustrating the processing of updating the contents of the operation records, which corresponds to the subroutine 4 at step ST10 of FIG. 7.

In FIG. 8, the processing measures the lighting time elapsed of the discharge lamp 6, first, and updates the cumulative lighting time stored in the third and fourth storing sections (step ST16); detects the voltage of the discharge lamp 6, and updates the change over time of the voltage of the discharge lamp 6 (step ST17); makes a decision, because the discharge lamp 6 is lit with AC, as to whether the timing for switching the polarity of the voltage applied to the discharge lamp 6 comes or not (step ST18); and controls, if it is the switching timing, the H bridge 5 to switch the polarity of the voltage applied to the discharge lamp 6 (step ST19).

Subsequently, the processing measures the reigniting voltage due to the polarity switching with the I/F 7, updates the reigniting voltage stored in the second storing section (step ST20); and measures the period of time during which the current does not flow, and updates the period of time during which the current does not flow stored in the second storing section (step ST21). Thus, the processing stores the measured period of time during which the current does not flow and the reigniting voltage into the storage device 10 as the operation records, and returns to the initial state of updating the contents of the operation records. In contrast, at step ST18, if it is not the switching timing of the polarity of the voltage applied to the discharge lamp 6, the processing returns to the initial state of updating the contents of the operation records to repeat the same operation as described above.

Figure 9:
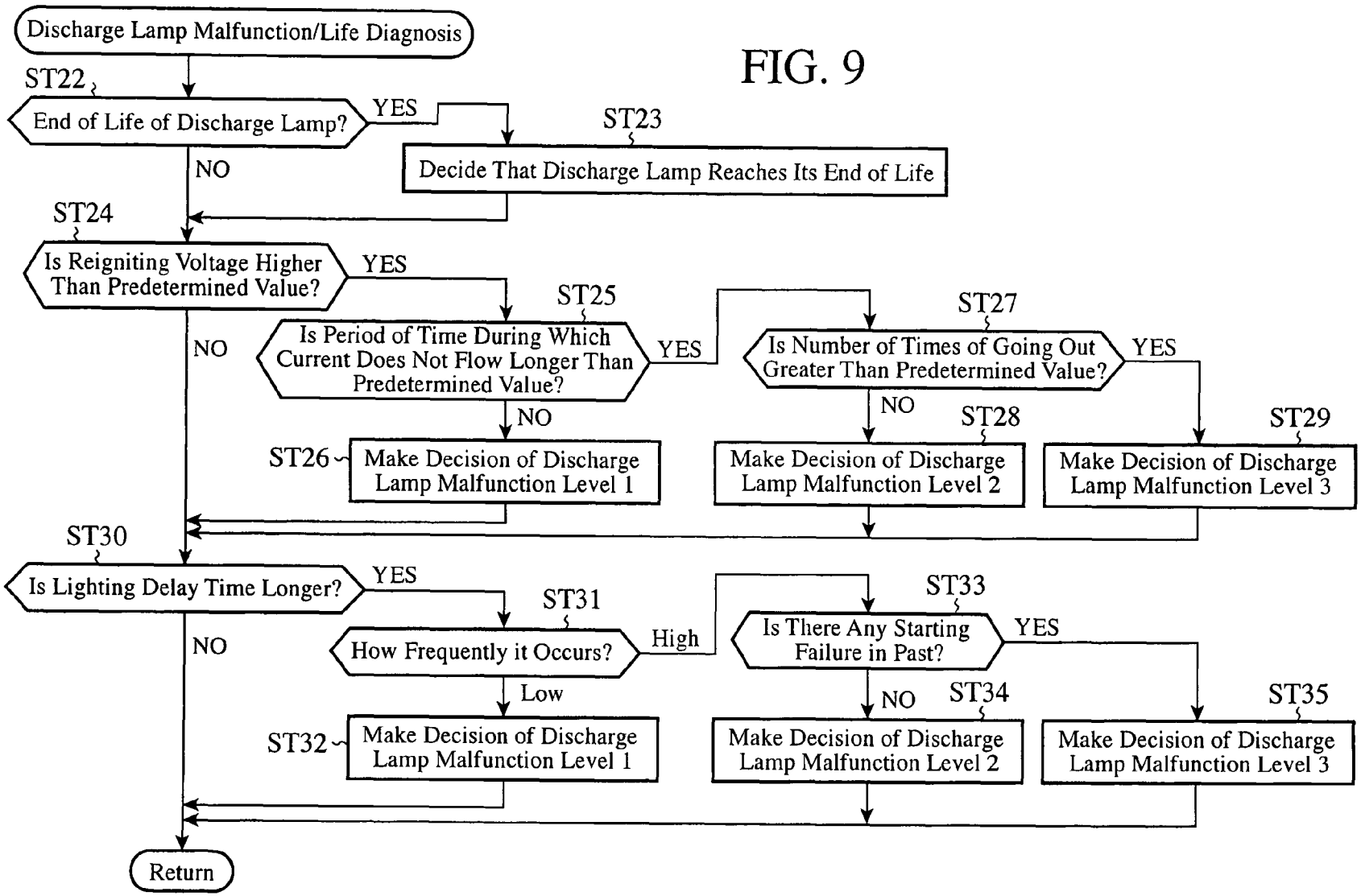
FIG. 9 is a flowchart illustrating operation of the malfunction/life diagnosis of the discharge lamp in the discharge lamp ballast apparatus of the embodiment 1 in accordance with the present invention.

FIG. 9 is a flowchart illustrating the processing of the discharge lamp malfunction/life diagnosis, which corresponds to the subroutine 5 at step ST11 of FIG. 7. Here, the processing carries out the diagnosis according to the cumulative lighting time/cumulative number of times of lighting of the discharge lamp 6. For example, it checks whether the cumulative lighting time of the discharge lamp 6 is greater than a predetermined value, or whether the cumulative number of times of lighting is greater than a predetermined value.

In FIG. 9, according to the cumulative lighting time (cumulative number of times of lighting) of the discharge lamp 6, the processing first makes a decision as to whether the cumulative lighting time or the like reaches the end of life of the discharge lamp 6 (step ST22), and decides, when reaching the end of life, that the life of the discharge lamp 6 ends (step ST23). In other words, step ST22 and step ST23 are a stage for making a decision as to the life of the discharge lamp 6 substantially. Unless the discharge lamp 6 reaches the end of life, the processing makes a decision as to whether the reigniting voltage of the discharge lamp 6 is higher than a predetermined value or not (step ST24). If the reigniting voltage is higher than the predetermined value, the processing makes a decision as to whether the period of time during which the current does not flow of the discharge lamp 6 is longer than a predetermined value or not (step ST25). Unless the period of time during which the current does not flow is longer, the processing makes a decision of the discharge lamp malfunction level 1 (mild malfunction) which does not offer any problem at present because the discharge lamp malfunction does not have the interruption of the current (step ST26).

In contrast, if the period of time during which the current does not flow is longer than the predetermined value at step ST25, the processing makes a decision as to whether the number of times of going out of the discharge lamp 6 is greater than a predetermined value or not (step ST27). Unless the number of times of going out of the discharge lamp 6 is greater than the predetermined value, the processing makes a decision of a discharge lamp malfunction level 2 (a moderate malfunction which means that a malfunction is likely to occur before long although it is well at present) which requires a warning to the user because there is a possibility of the discharge lamp malfunction, and the flicker is likely to occur (step ST28). In contrast, if the number of times of going out of the discharge lamp 6 is greater than the predetermined value, the processing makes a decision of a discharge lamp malfunction level 3 (a severe malfunction for which a complaint will come) that the flicker or blinking of the discharge lamp 6 takes place, and it must be replaced before it reaches a lighting disabled state because it is difficult to maintain lighting (step ST29). In other words, steps ST24-ST29 are a stage which decides the malfunction during the lighting of the discharge lamp 6 by dividing into the malfunction levels substantially.

On the other hand, the processing makes a decision as to whether the lighting delay time of the discharge lamp 6 is longer than a predetermined value or not (step ST30). If the lighting delay time is longer than the predetermined value, the processing makes a decision as to whether the frequency of occurrence of the lighting delay is higher than a predetermined value or not, that is, whether the lighting delay of the discharge lamp 6 occurs suddenly or continuously (step ST31). If the frequency of occurrence is lower, the processing makes a decision of a discharge lamp malfunction level 1 (mild malfunction) because although the lighting delay of the discharge lamp 6 occurs, since its frequency is low, there is no problem at present (step ST32). In contrast, if the frequency of occurrence of the lighting delay of the discharge lamp 6 is higher than the predetermined value at step ST31, the processing makes a decision as to whether there was starting failure in the past (although it is stored in the first storing section, its frequency is stored in the fourth storing section) (step ST33). Unless the starting failure of the discharge lamp 6 occurred in the past, the processing makes a decision of the discharge lamp malfunction level 2 (moderate malfunction)

which requires a warning to the user because the lighting delay occurs frequently and it is very likely to reach a fault (starting failure) (step ST34).

In contrast, if a decision is made at step ST33 that the starting failure of the discharge lamp 6 occurred in the past, the processing makes a decision of a discharge lamp malfunction level 3 (severe malfunction) which requires the replacement of the discharge lamp before it falls in a totally starting disabled state because its starting characteristics are very bad (step ST35). In other words, steps ST30-ST35 constitute a stage of making a decision by dividing the malfunction during startup of the discharge lamp 6 into the malfunction levels substantially. After completing the decision processing at steps ST32, ST34 and ST35, the processing returns to the initial state of the discharge lamp malfunction/life diagnosis. Likewise, when a decision is made at step ST30 that the lighting delay time of the discharge lamp 6 is not longer than the predetermined value, the processing returns to the initial state of the discharge lamp malfunction/life diagnosis to repeat the same operation as described above.

Figure 10:
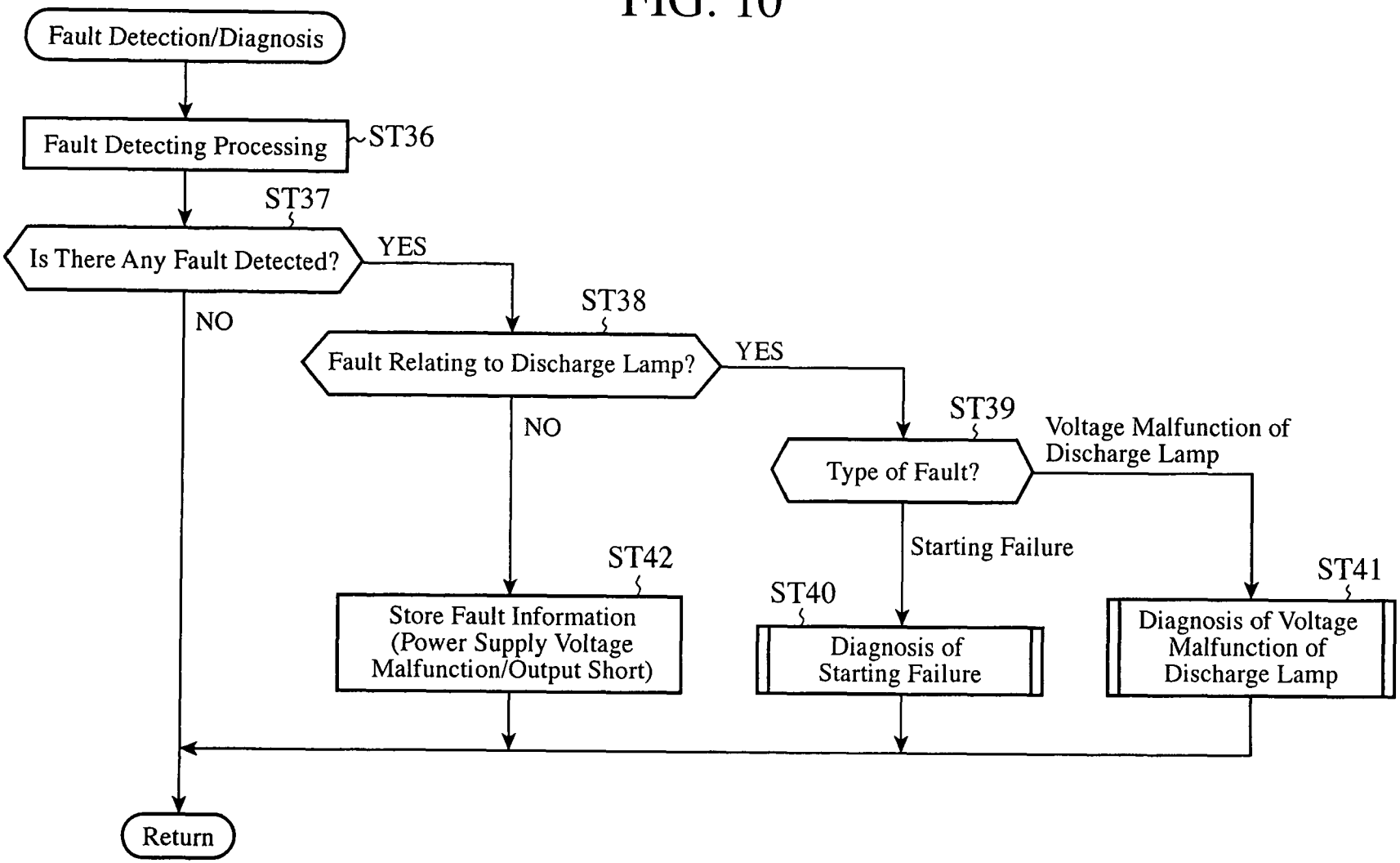
FIG. 10 is a flowchart illustrating operation of the fault detection/diagnosis in the discharge lamp ballast apparatus of the embodiment 1 in accordance with the present invention.

FIG. 10 is a flowchart illustrating the processing of the fault detection/diagnosis, which corresponds to the subroutine 6 at step ST3 of FIG. 5. Here, to decide the type of the fault of the discharge lamp ballast apparatus, the four patterns can be considered: a power supply voltage malfunction; a discharge lamp voltage malfunction; a starting failure; and an output short circuit (short/ground fault/supply fault).

In FIG. 10, the processing enters the fault detecting processing, first (step ST36). Then, the processing makes a decision as to whether there is any fault detection about the discharge lamp ballast apparatus using the fault detecting section 9*b*, that is, which one of the four patterns applies (step ST37). If there is any fault detection, the processing makes a decision as to whether the fault relates to the discharge lamp 6 or not (step ST38). If the fault relates to the discharge lamp 6, the processing identifies as to the fault detected whether it is a starting failure in which the discharge lamp 6 cannot light up within a certain fixed period, or the discharge lamp voltage malfunction which means that the discharge lamp voltage is not within a standard range such as within a threshold level of 50-100 V (step ST39). If the fault is a starting failure, the processing proceeds to a subroutine 7 (FIG. 11) which carries out the diagnosis of the starting failure and which will be described later (step ST40). In contrast, if the fault is the discharge lamp voltage malfunction, the processing proceeds to a subroutine 8 (FIG. 12) which carries out the diagnosis of the discharge lamp voltage malfunction and which will be described later (step ST41).

On the other hand, if a decision is made step ST38 that the fault does not relate to the discharge lamp 6, the processing stores the power supply voltage malfunction and the output short circuit (short/ground fault/supply fault) as the fault information (step ST42). Thus, after completing the diagnosis processing at steps ST40 and ST41 and the storing processing at step ST42, the processing returns to the initial state of the fault detection/diagnosis. Likewise, unless there is the fault detection at step ST37, the processing returns to the initial state of the fault detection/diagnosis to repeat the same operation as described above.

Figure 11:
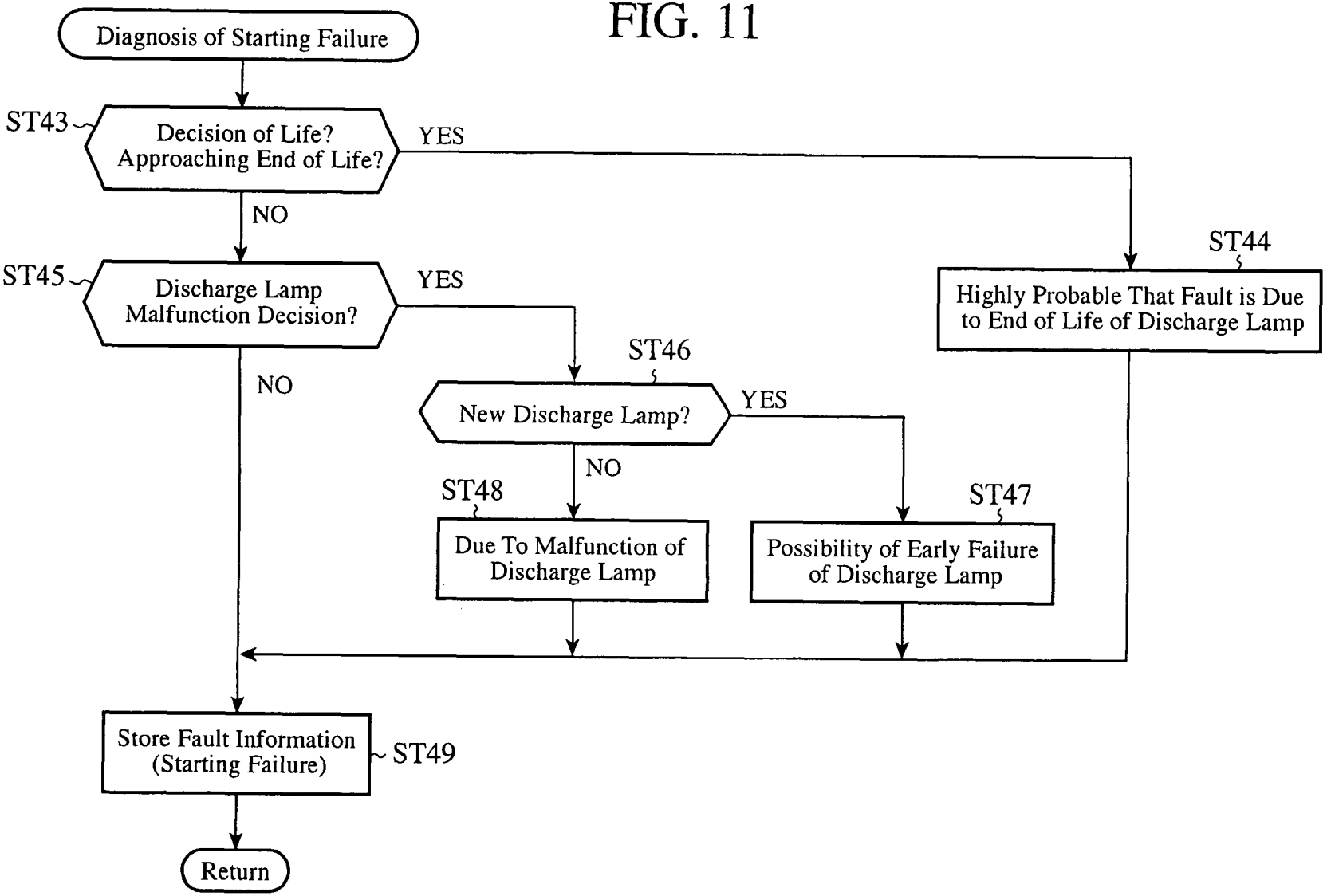
FIG. 11 is a flowchart illustrating diagnostic operation at a starting failure in the discharge lamp ballast apparatus of the embodiment 1 in accordance with the present invention.

FIG. 11 is a flowchart illustrating the processing of the diagnosis of the starting failure, which corresponds to the subroutine 7 at step ST40 of FIG. 10.

In FIG. 11, the processing decides the life of the discharge lamp 6 from the cumulative lighting time/the cumulative number of times of lighting and the like, and makes a decision as to whether it approaches the end of its life or not (step ST43). If it approaches the end of its life, the processing makes a decision that the fault is probably due to the end of life of the discharge lamp (step ST44). In contrast, unless the life approaches its end at step ST43, the processing makes a decision as to whether the processing is the discharge lamp malfunction decision or not (step ST45). If it is the discharge lamp malfunction decision, the processing makes a decision as to whether the discharge lamp 6 is new or not from the cumulative lighting time/cumulative number of times of lighting or the like (step ST46). If it is new, the processing makes a decision that the discharge lamp 6 is likely to have an early failure (step ST47). If it is not new, the processing makes a decision that the fault is due to the malfunction of the discharge lamp 6 (step ST48). In either case, the processing proceeds to step ST49 for storing the fault information. Unless the processing is the discharge lamp malfunction decision at step ST45, since the cause of the fault cannot be decided from the operation records, the processing also proceeds to step ST49. At step ST49, after storing the starting failure of the discharge lamp 6 as the fault information, the processing returns to the initial state of the diagnosis of the starting failure to repeat the same operation as described above.

Figure 12:
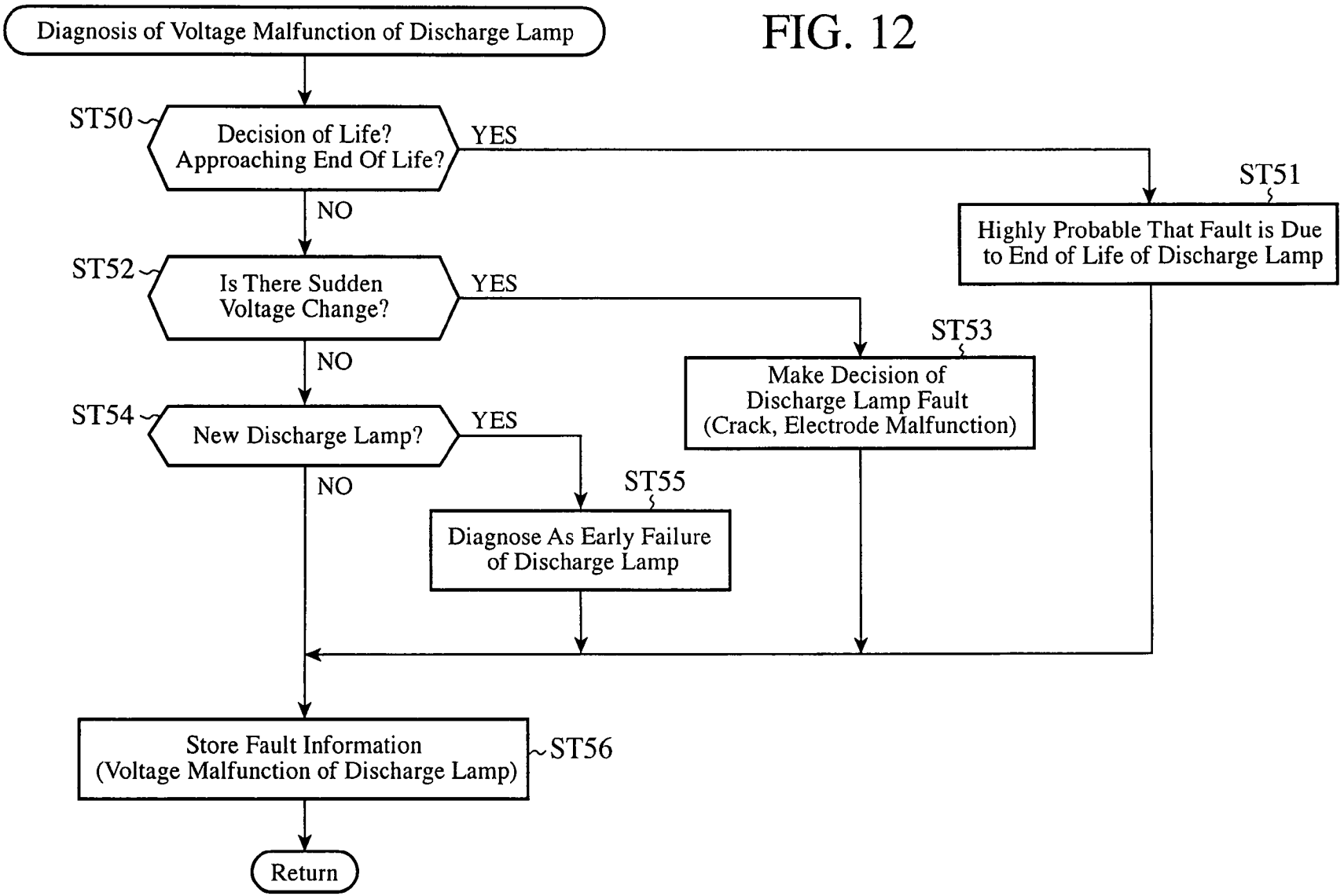
FIG. 12 is a flowchart illustrating diagnostic operation of voltage malfunction of the discharge lamp in the discharge lamp ballast apparatus of the embodiment 1 in accordance with the present invention.

FIG. 12 is a flowchart illustrating the processing of the diagnosis of the discharge lamp voltage malfunction, which corresponds to the subroutine 8 at step ST41 of FIG. 10.

In FIG. 12, the processing decides the life of the discharge lamp 6 from the cumulative lighting time/the cumulative number of times of lighting or the like, and makes a decision as to whether it approaches the end of its life or not (step ST50). If it approaches the end of its life, the processing makes a decision that the fault is probably due to the end of life of the discharge lamp (step ST51). In contrast, unless it approaches the end of life at step ST50, the processing makes a decision as to whether the sudden voltage variation occurs or not (step ST52). If the sudden voltage variation occurs, the processing decides that the discharge lamp 6 has a fault (such as a crack and a malfunction of an electrode) (step ST53).

Unless the sudden voltage variation occurs at step ST52, the processing makes a decision as to whether the discharge lamp 6 is new or not from the cumulative lighting time/cumulative number of times of lighting or the like (step ST54). If it is new, the processing decides that the discharge lamp 6 has an early failure (step ST55), and then proceeds to step ST56 for storing the fault information. Unless the discharge lamp 6 is new at step ST54, since the cause of the fault cannot be decided from the operation records, the processing also proceeds to step ST56. At step ST56, after storing the voltage malfunction of the discharge lamp 6 as the fault information, the processing returns to the initial state of the diagnosis of the discharge lamp voltage malfunction to repeat the same operation as described above.

As described above, the present embodiment always stores into the storage device 10 the information about the lighting of the discharge lamp 6 such as the lighting delay time, the reigniting voltage, the period of time during which the current does not flow, and the number of times of going out of the discharge lamp 6 as the operation records. Thus, it can detect the distinctive characteristics of each discharge lamp 6 early, and notify the user before the fault occurs such as the lighting disabled state and flicker.

In addition, the present embodiment can distinguish between the end of life and the malfunction of the discharge lamp 6 by storing the cumulative lighting time, the cumulative number of times of lighting, and the change over time of the discharge lamp voltage of the discharge lamp 6 as the operation records. Thus, it can detect the malfunction more accurately.

Furthermore, the present embodiment stores, if the discharge lamp ballast apparatus has a fault, the type of the fault, the operation records at the occurrence of the fault, the lighting time elapsed up to the detection of the fault, and the discharge lamp voltage as the fault information. Thus, the present embodiment can estimate the distinctive characteristics of the discharge lamp 6, the conditions of the discharge lamp at the occurrence of the fault, and the occurring conditions (can identify the lighting startup period, the initial lighting period, and the steady lighting period from the lighting time elapsed or the discharge lamp voltage of the discharge lamp 6; can estimate the short going out duration from the discharge lamp voltage immediately after the lighting; and can identify the short blinking). Thus, the present embodiment is effective for identifying the cause of a fault with low reproducibility, which can take place only in particular conditions. In addition, displaying the operation records and fault information on the external apparatus 11 enables the worker to look at them, and this can facilitate the operations.

INDUSTRIAL APPLICABILITY

As described above, the discharge lamp ballast apparatus in accordance with the present invention is suitable for being mounted on a vehicle, and for implementing the discharge lamp ballast apparatus that is very good at identifying the cause of the fault, and can foresee a fault and notify of it.

What is claimed is:

1. A discharge lamp ballast apparatus comprising:

a power supply section for supplying AC power to a discharge lamp from a DC power supply;

a lighting control section connected to said power supply section for controlling operation of said power supply section;

a fault detecting section for detecting a fault of the discharge lamp;

a first storing section for storing fault detected by said fault detecting section;

a lighting delay detecting section for detecting lighting delay time from beginning of starting operation to lighting of the discharge lamp;

a reigniting voltage measuring section for measuring a discharge lamp voltage immediately after switching of polarity applied to the discharge lamp according to AC lighting as a reigniting voltage;

a no-current flowing duration measuring section for measuring a period of time during which a current does not flow by detecting a discharge lamp current immediately after switching the polarity applied to the discharge lamp according to the AC lighting;

a going out counting section for counting a number of times of going out by detecting going out during lighting of the discharge lamp; and a second storing section for storing into a storage device respective outputs of said lighting delay detecting section, said reigniting voltage measuring section, said no-current flowing duration measuring section and said going out counting section as operation records.

2. The discharge lamp ballast apparatus according to claim 1, further comprising:

a third storing section for storing a point of time of occurrence of the fault said first storing section stores, and for storing lighting conditions at the point of time of occurrence of the fault.

3. The discharge lamp ballast apparatus according to claim 2, further comprising:

an output section for outputting stored contents in said first storing section, in said second storing section or in said third storing section.

4. A discharge lamp ballast apparatus comprising:

a power supply section for supplying AC power to a discharge lamp from a DC power supply;

a lighting control section connected to said power supply section for controlling operation of said power supply section;

a lighting delay detecting section for detecting lighting delay time from beginning of starting operation to lighting of the discharge lamp;

a reigniting voltage measuring section for measuring a discharge lamp voltage immediately after switching of polarity applied to the discharge lamp according to AC lighting as a reigniting voltage;

a no-current flowing duration measuring section for measuring a period of time during which a current does not flow by detecting a discharge lamp current immediately after switching the polarity applied to the discharge lamp according to the AC lighting;

a going out counting section for counting a number of times of going out by detecting going out during lighting of the discharge lamp;

a second storing section for storing into a storage device respective outputs of said lighting delay detecting section, said reigniting voltage measuring section, said no-current flowing duration measuring section and said going out counting section as operation records;

a fourth storing section for storing a lighting history of said discharge lamp;

a decision section for making a decision of a state of the discharge lamp on a basis of information stored in said second storing section and in said fourth storing section; and a warning section for notifying a driver of the state of the discharge lamp on a basis of a decision result of said decision section.

5. The discharge lamp ballast apparatus according to claim 4, wherein said decision section makes a decision by dividing a discharge state of the discharge lamp into malfunction levels on a basis of prescribed conditions.

6. The discharge lamp ballast apparatus according to claim 4, wherein said decision section decides a discharge state during lighting of the discharge lamp on a basis on whether the reigniting voltage is higher than a predetermined value or not, whether the period of time during which the current does not flow is longer than a predetermined value, and whether the going out occurs during the lighting of the discharge lamp.

7. The discharge lamp ballast apparatus according to claim 4, wherein said decision section decides a discharge state during startup of the discharge lamp on a basis on whether the lighting delay of the discharge lamp occurs or not, whether the lighting delay, if it occurs, is limited to only one occasion or not, and whether starting of the discharge lamp has failed or not.

8. The discharge lamp ballast apparatus according to claim 4, wherein said warning section changes its notification level in response to the malfunction levels of the discharge lamp.

* * * * *